US009709927B1

(12) United States Patent
Bacelieri et al.

(10) Patent No.: US 9,709,927 B1
(45) Date of Patent: Jul. 18, 2017

(54) DEVELOPER UNIT AIR VENTING IN A DUAL COMPONENT DEVELOPMENT ELECTROPHOTOGRAPHIC IMAGE FORMING DEVICE

(71) Applicant: LEXMARK INTERNATIONAL, INC., Lexington, KY (US)

(72) Inventors: Michael Brian Bacelieri, Lexington, KY (US); Robert Dan Bennett, III, Paris, KY (US); Jenny Marie Berens, Winchester, KY (US); Mark Leo Doerre, Lexington, KY (US); Courtney Harrison Soale, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/058,200

(22) Filed: Mar. 2, 2016

(51) Int. Cl.
*G03G 15/09* (2006.01)

(52) U.S. Cl.
CPC ..... *G03G 15/0921* (2013.01); *G03G 15/0942* (2013.01)

(58) Field of Classification Search
CPC ..... G03G 15/0832; G03G 15/0834; G03G 15/0846; G03G 15/0875; G03G 15/0887–15/0893; G03G 15/0921; G03G 15/0942
See application file for complete search history.

(56) References Cited

U.S. PATENT DOCUMENTS 4,583,112 A * 4/1986 Morano ..... G03G 15/0898 399/103
4,800,411 A * 1/1989 Tanaka ..... G03G 15/0898 399/103
9,152,089 B1 10/2015 Denton et al.
9,188,907 B1 11/2015 Bennett et al.
2009/0232543 A1* 9/2009 Urasawa ..... G03G 15/0898 399/113
2010/0215401 A1* 8/2010 Fujiwara ..... G03G 15/09 399/119
2011/0008068 A1* 1/2011 Kunihiro ..... G03G 15/0844 399/92
2011/0262174 A1* 10/2011 Gumbe ..... G03G 15/0898 399/92
2013/0034368 A1* 2/2013 Hattori ..... G03G 15/0881 399/106

(Continued)

*Primary Examiner* — David M Gray
*Assistant Examiner* — Carla Therrien
(74) *Attorney, Agent, or Firm* — Justin M. Tromp

(57) ABSTRACT

A developer unit according to one example embodiment includes a housing having a reservoir for storing a developer mix that includes toner and magnetic carrier beads. A magnetic roll is mounted on the housing. An outer surface of a sleeve of the magnetic roll is positioned to carry the developer mix from the reservoir through a front portion of the magnetic roll that is exposed from the reservoir to permit transfer of toner from the outer surface of the sleeve to a photoconductive drum and back to the reservoir as the sleeve rotates in an operative rotational direction. An air vent is positioned along a rear portion of the magnetic roll for exiting air in the reservoir from the housing. An entire opening of the air vent is positioned vertically higher than the rotational axis of the sleeve when the developer unit is in an operative orientation.

22 Claims, 6 Drawing Sheets

(56) References Cited

U.S. PATENT DOCUMENTS

| | | | | |
|---|---|---|---|---|
| 2014/0169827 | A1* | 6/2014 | Hattori | G03G 15/0882 399/106 |
| 2014/0376951 | A1* | 12/2014 | Ogawa | G03G 15/0898 399/98 |
| 2015/0362861 | A1* | 12/2015 | Oshikawa | G03G 15/0882 399/103 |

* cited by examiner

DEVELOPER UNIT AIR VENTING IN A DUAL COMPONENT DEVELOPMENT ELECTROPHOTOGRAPHIC IMAGE FORMING DEVICE

CROSS REFERENCES TO RELATED APPLICATIONS

None.

BACKGROUND

1. Field of the Disclosure

The present disclosure relates generally to image forming devices and more particularly to developer unit air venting in a dual component development electrophotographic image forming device.

2. Description of the Related Art

Dual component development electrophotographic image forming devices include one or more reservoirs that store a mixture of toner and magnetic carrier beads (the "developer mix"). Toner is electrostatically attracted to the carrier beads as a result of triboelectric interaction between the toner and the carrier beads. A magnetic roll includes a stationary core having one or more permanent magnets and a sleeve that rotates around the core. The permanent magnet(s) produce a series of magnetic poles that are circumferentially spaced around the outer surface of the sleeve. The magnetic poles attract the carrier beads in the reservoir having toner thereon to the outer surface of the sleeve, which transports the developer mix as the sleeve rotates. A photoconductive drum is charged by a charge roll to a predetermined voltage and a laser selectively discharges areas on the surface of the photoconductive drum to form a latent image on the surface of the photoconductive drum. The sleeve of the magnetic roll carries the developer mix in close proximity to the photoconductive drum. The sleeve is electrically biased to facilitate the transfer of toner from the chains of developer mix on the outer surface of the sleeve to the discharged areas on the surface of the photoconductive drum forming a toner image on the surface of the photoconductive drum. The photoconductive drum then transfers the toner image, directly or indirectly, to a media sheet forming a printed image on the media sheet. Developer mix on the outer surface of the sleeve that is not transferred to the photoconductive drum is transported by the sleeve back to the reservoir. After the remaining developer mix reenters the reservoir, the developer mix is no longer magnetically retained against the outer surface of the sleeve allowing the developer mix to release from the sleeve back into the reservoir.

As the developer mix is released back into the reservoir, toner particles may separate from the carrier beads and drift into the air. This undesirable condition is commonly referred to as toner dusting or fuming. The separated toner particles are susceptible to being carried out of the reservoir by airflow which may contaminate other components of the image forming device. Accordingly, reduction of toner dusting and leakage is desired.

SUMMARY

A developer unit for a dual component development electrophotographic image forming device according to one example embodiment includes a housing having a reservoir for storing a developer mix that includes toner and magnetic carrier beads. A magnetic roll is mounted on the housing.

The magnetic roll includes a core and a sleeve positioned around the core. The sleeve is rotatable in an operative rotational direction around the core about a rotational axis. The core includes at least one permanent magnet having a plurality of circumferentially spaced magnetic poles that magnetically attract the developer mix to an outer surface of the sleeve for carrying by the sleeve as the sleeve rotates in the operative rotational direction. The outer surface of the sleeve is positioned to carry the developer mix from the reservoir through a front portion of the magnetic roll that is exposed from the reservoir to permit transfer of toner from the outer surface of the sleeve to a photoconductive drum and back to the reservoir as the sleeve rotates in the operative rotational direction. An air vent is positioned along a rear portion of the magnetic roll opposite the front portion of the magnetic roll for exiting air in the reservoir from the housing. An entire opening of the air vent is positioned vertically higher than the rotational axis of the sleeve when the developer unit is in an operative orientation.

A developer unit for a dual component development electrophotographic image forming device according to another example embodiment includes a housing having a reservoir for storing a developer mix that includes toner and magnetic carrier beads. A magnetic roll is mounted on the housing. The magnetic roll includes a core and a sleeve positioned around the core. The sleeve is rotatable in an operative rotational direction around the core about a rotational axis. The core includes at least one permanent magnet having a plurality of circumferentially spaced magnetic poles that magnetically attract the developer mix to an outer surface of the sleeve for carrying by the sleeve as the sleeve rotates in the operative rotational direction. The outer surface of the sleeve is positioned to carry the developer mix from the reservoir through a portion of the magnetic roll that is exposed from the reservoir to permit transfer of toner from the outer surface of the sleeve to a photoconductive drum and back to the reservoir as the sleeve rotates in the operative rotational direction. An air vent is positioned in close proximity to the outer surface of the sleeve for exiting air in the reservoir from the housing. The air vent is positioned downstream from a point where developer mix on the outer surface of the sleeve reenters the housing after passing the exposed portion of the magnetic roll during rotation of the sleeve in the operative rotational direction and upstream from a point where the developer mix releases from the outer surface of the sleeve after reentering the housing during rotation of the sleeve in the operative rotational direction.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
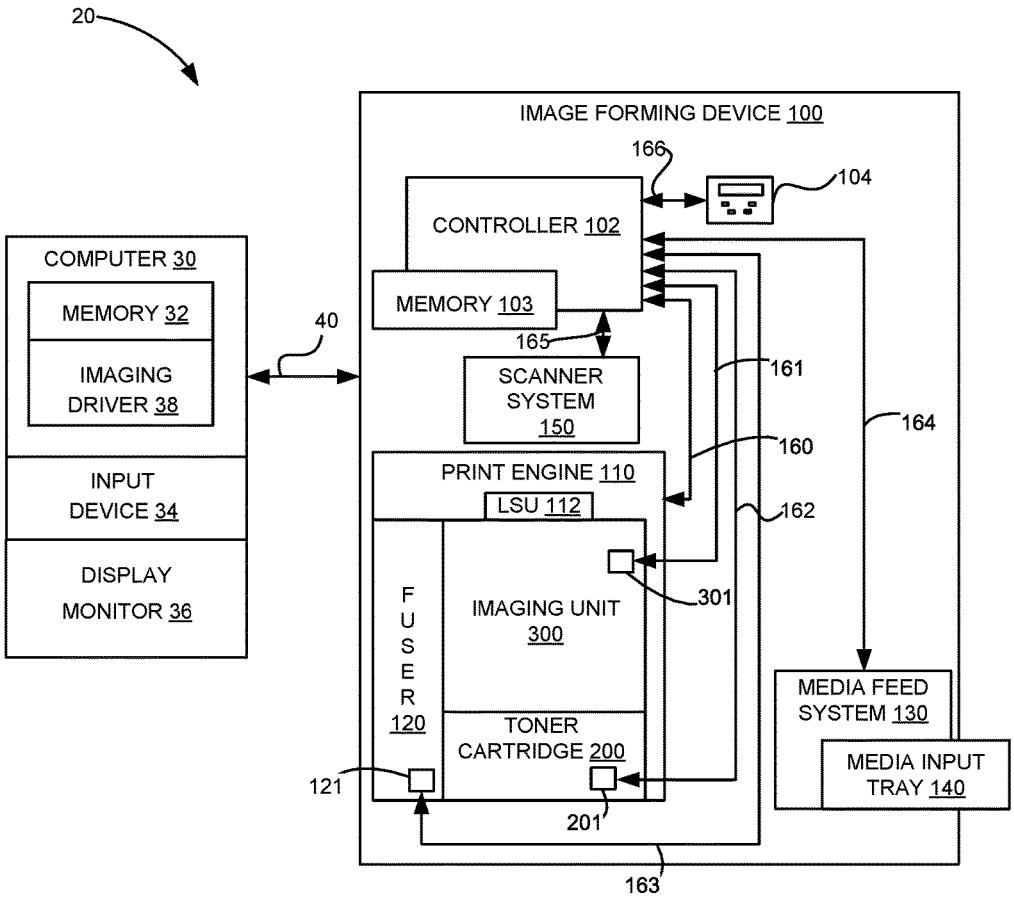
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112. one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103. The processor may include one or more integrated circuits in the form of a microprocessor or central processing unit and may be formed as one or more Application Specific Integrated Circuits (ASICs). Memory 103 may be any volatile or non-volatile memory or combination thereof, such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory, such as RAM, ROM, and/or NVRAM, and may provide authentication functions, safety and operational interlocks, operating parameters and usage information related to fuser 120, toner cartridge(s) 200 and imaging units 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer, such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
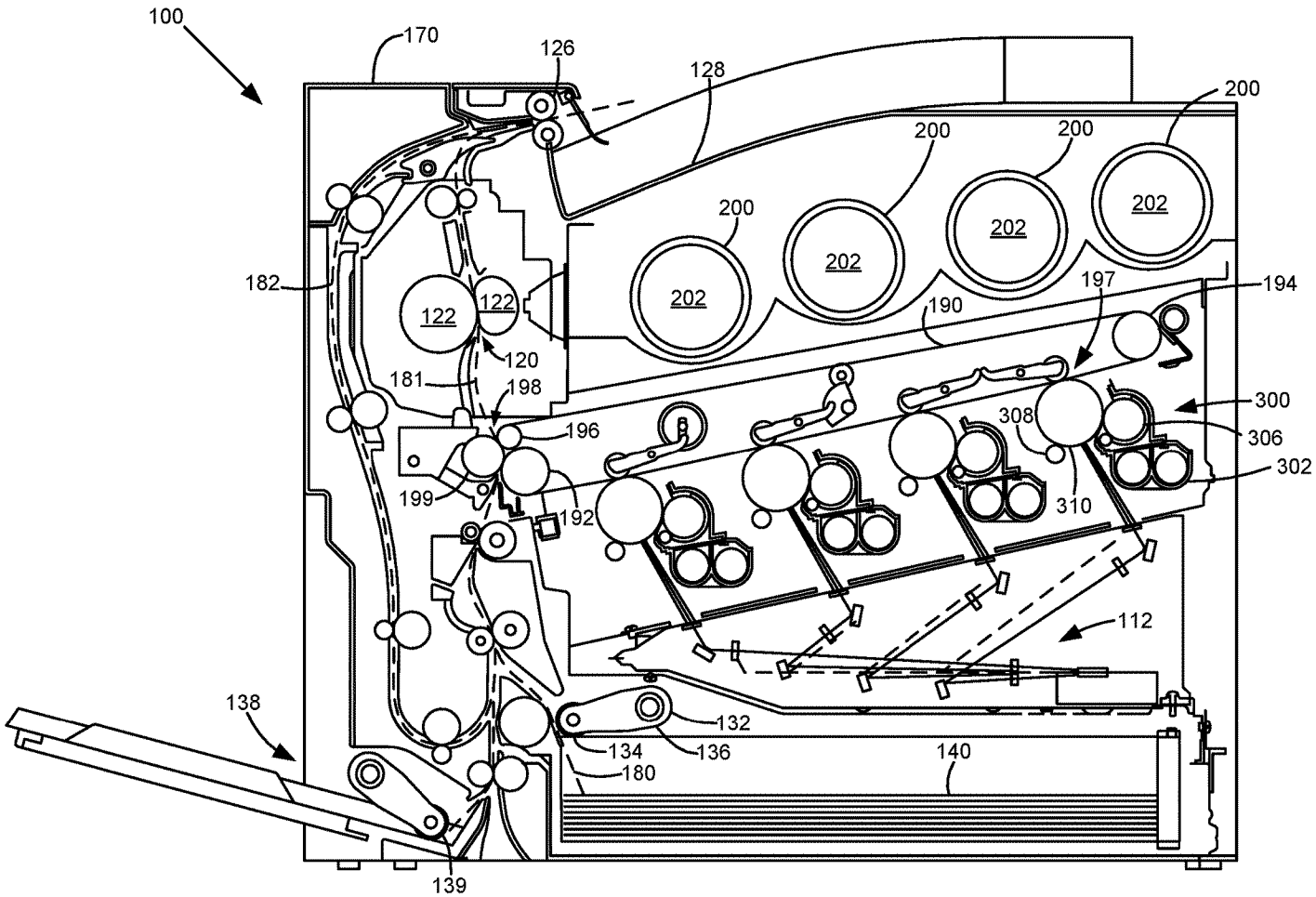
FIG. 2 is a schematic diagram of an image forming device according to one example embodiment.

FIG. 2 illustrates a schematic view of the interior of an example image forming device 100. For purposes of clarity, the components of only one of the imaging units 300 are labeled in FIG. 2. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300, which may also be removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 include yellow, cyan, magenta and black toner.

Image forming device 100 utilizes what is commonly referred to as a dual component development system. Each imaging unit 300 includes a reservoir 302 that stores a mixture of toner and magnetic carrier beads. The carrier beads may be coated with a polymeric film to provide triboelectric properties to attract toner to the carrier beads as the toner and the carrier beads are mixed in reservoir 302. Reservoir 302 and a magnetic roll 306 collectively form a developer unit. Each imaging unit 300 also includes a charge roll 308, a photoconductive (PC) drum 310 and a cleaner blade or roll (not shown) that collectively form a PC unit. PC drums 310 are mounted substantially parallel to each other when the imaging units 300 are installed in image forming device 100. In the example embodiment illustrated, each imaging unit 300 is substantially the same except for the color of toner contained therein.

Each charge roll 308 forms a nip with the corresponding PC drum 310. During a print operation, charge roll 308 charges the surface of PC drum 310 to a specified voltage, such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. Magnetic roll 306 attracts the carrier beads in reservoir 302 having toner thereon to magnetic roll 306 through the use of magnetic fields and transports the toner to the corresponding PC drum 310. Electrostatic forces from the latent image on PC drum 310 strip the toner from the carrier beads to form a toner image on the surface of PC drum 310.

An intermediate transfer mechanism (TIM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a first transfer nip 197. In one embodiment, a positive voltage field attracts the toner image from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196. The cleaner blade/roll removes any toner remnants on PC drum 310 so that the surface of PC drum 310 may be charged and developed with toner again.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128. In a reverse direction, exit rolls 126 move the media sheet into duplex path 182 for image formation on a second side of the media sheet.

While the example image forming device 100 shown in FIG. 2 illustrates four toner cartridges 200 and four corresponding imaging units 300, it will be appreciated that a monocolor image forming device 100 may include a single toner cartridge 200 and corresponding imaging unit 300 as compared to a color image forming device 100 that may include multiple toner cartridges 200 and imaging units 300. Further, although image forming device 100 utilizes ITM 190 to transfer toner to the media, toner may be applied directly to the media by the one or more photoconductive drums 310 as is known in the art. In addition, toner may be transferred directly from each toner cartridge 200 to its corresponding imaging unit 300 or the toner may pass through an intermediate component, such as a chute, duct or hopper, that connects the toner cartridge 200 with its corresponding imaging unit 300.

Imaging unit(s) 300 may be replaceable in any combination desired. For example, in one embodiment, the developer unit and PC unit are provided in separate replaceable units from each other. In another embodiment, the developer unit and PC unit are provided in a common replaceable unit. In another embodiment, toner reservoir 202 is provided with the developer unit instead of in a separate toner cartridge 200. For a color image forming device 100 the developer unit and PC unit of each color toner may be separately replaceable or the developer unit and/or the PC unit of all colors (or a subset of all colors) may be replaceable collectively as desired.

Figure 3:
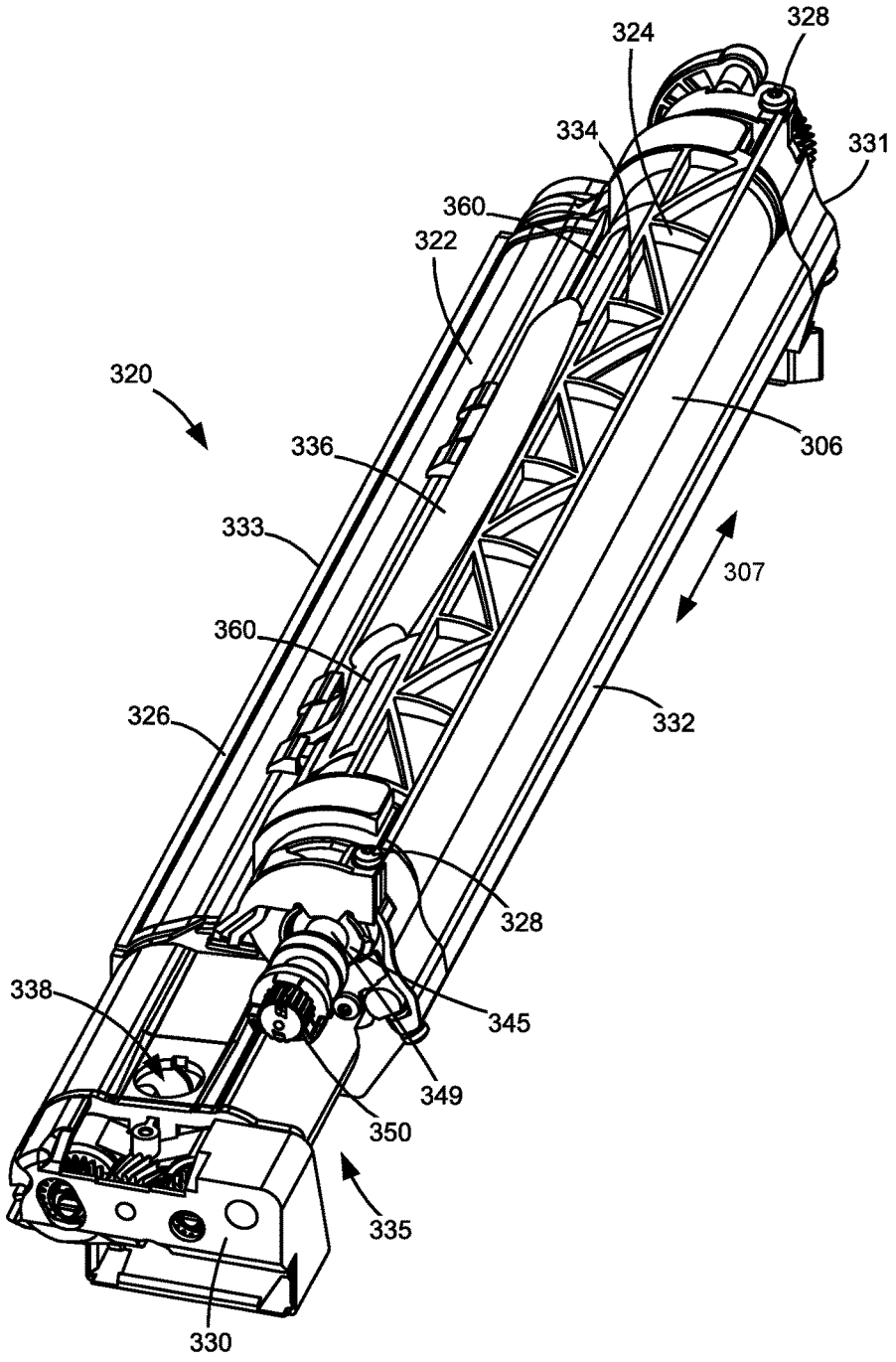
FIG. 3 is a front perspective view of a developer unit according to one example embodiment.
Figure 4:
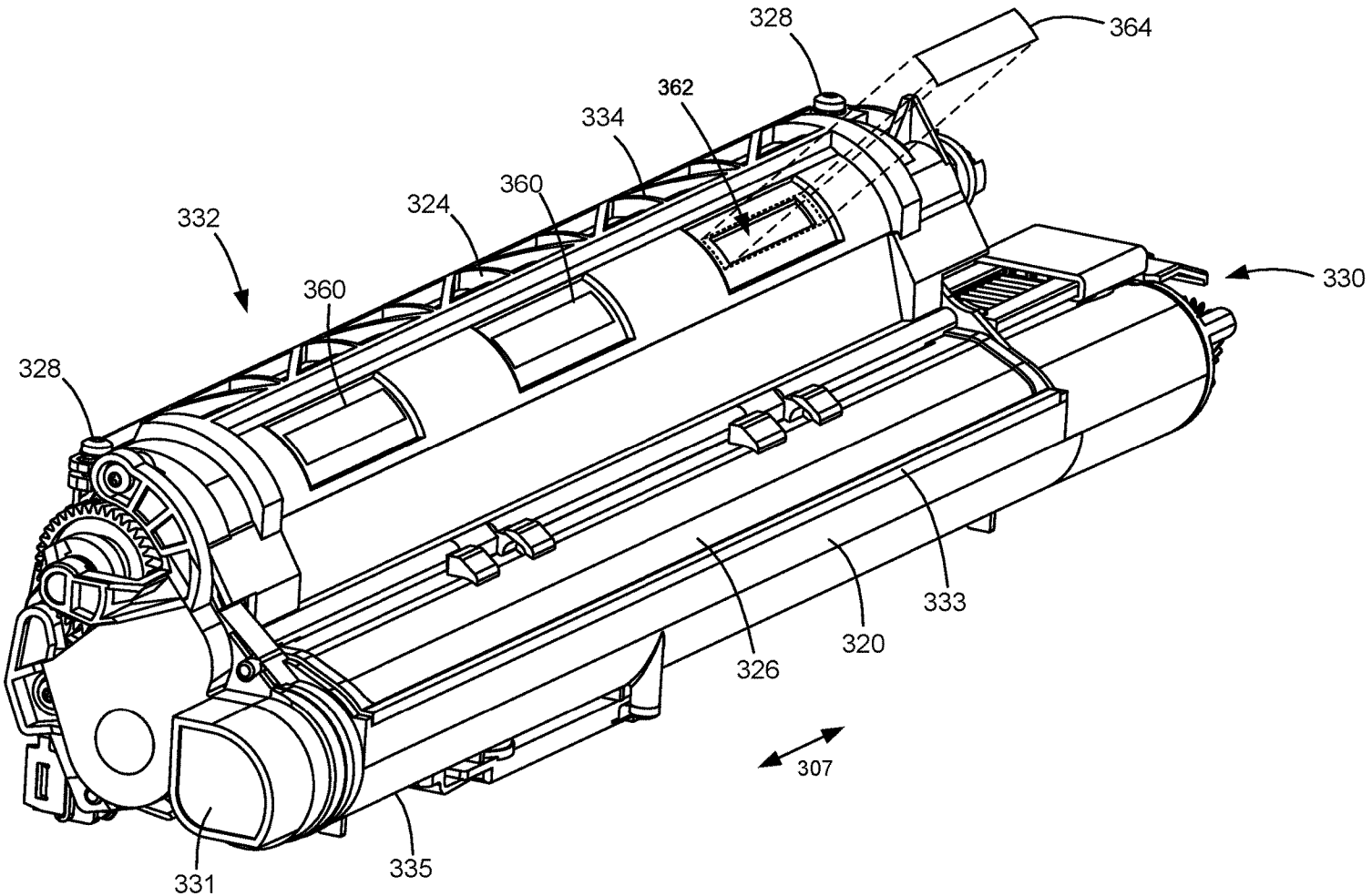
FIG. 4 is a rear perspective view of the developer unit shown in FIG. 3.

FIGS. 3 and 4 show a developer unit 320 according to one example embodiment. Developer unit 320 includes a housing 322 having reservoir 302 therein. In some embodiments, housing 322 includes a lid 324 mounted on a base 326. Lid 324 may be attached to base 326 by any suitable construction including, for example, by fasteners (e.g., screws 328), adhesive and/or welding. Alternatively, lid 324 may be formed integrally with base 326. In the example embodiment illustrated, base 326 includes a top portion **326*a* attached (e.g., by fasteners, adhesive and/or welding) to a lower portion 326*b*. Alternatively, top portion 326*a* of base 326 may be formed integrally with lower portion 326*b* of base 326. Housing 322 extends generally along an axial dimension 307 of magnetic roll 306 from a first end 330 of housing 322 to a second end 331 of housing 322. End 330 leads during insertion of developer unit 320 into image forming device 100 and end 331 trails. A portion of magnetic roll 306 is exposed from reservoir 302 at a front 332 of housing 322. A handle 336 is optionally positioned on a rear 333 of housing 322 to assist with separating developer unit 320 from the corresponding PC unit. Housing 322 also includes a top 334 and a bottom 335**.

Reservoir 302 holds the mixture of toner and magnetic carrier beads (the "developer mix"). Developer unit 320 includes an inlet port 338 in fluid communication with reservoir 302 and positioned to receive toner from toner cartridge 200 to replenish reservoir 302 when the toner concentration in reservoir 302 relative to the amount of carrier beads remaining in reservoir 302 gets too low as toner is consumed from reservoir 302 by the printing process. In the example embodiment illustrated, inlet port 338 is positioned on top 334 of housing 322 near end 330; however, inlet port 338 may be positioned at any suitable location on housing 322.

Figure 5:
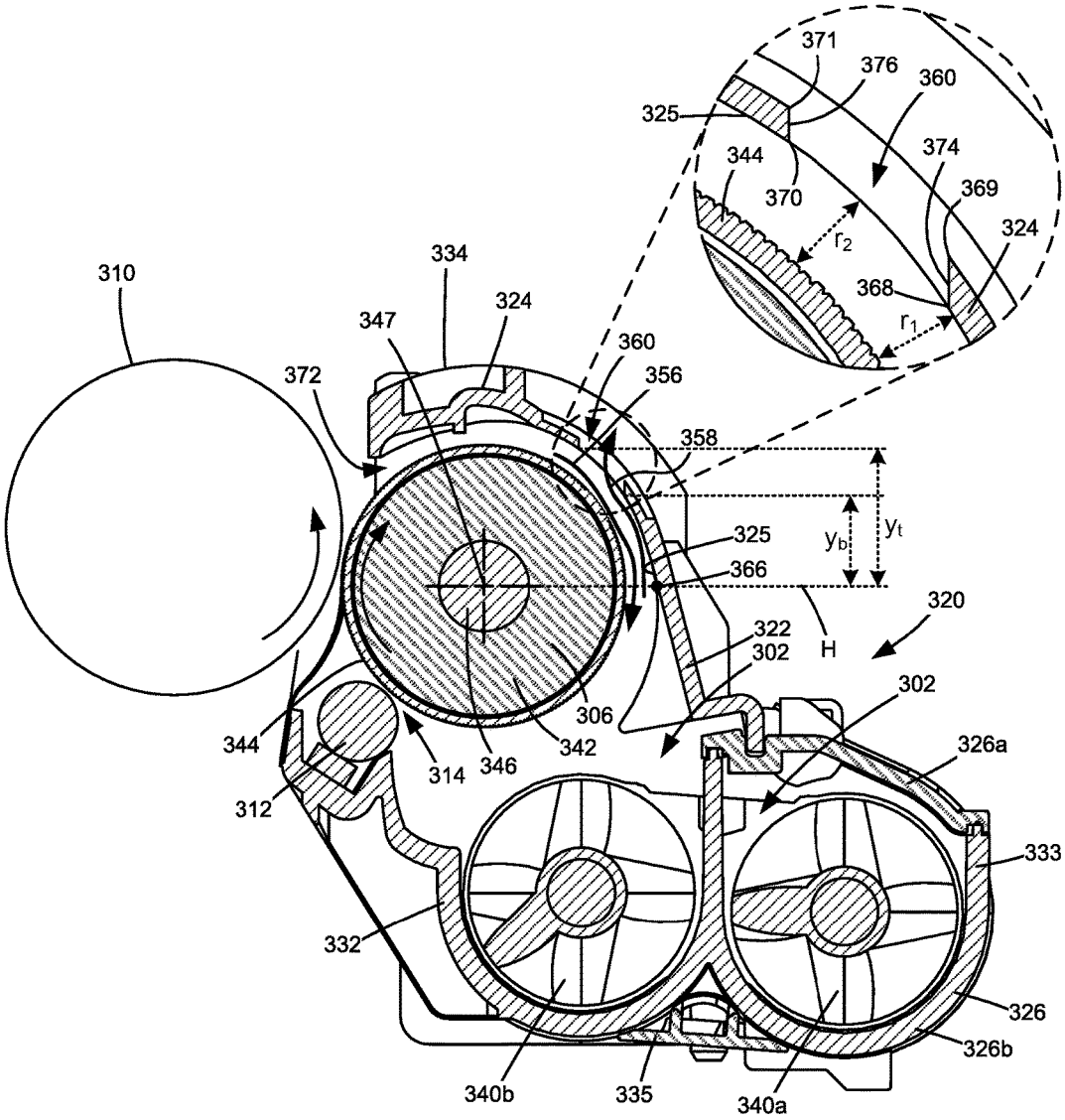
FIG. 5 is a cross-sectional view of the developer unit shown in FIGS. 3 and 4.

With reference to FIG. 5, reservoir 302 includes one or more agitators to stir and move the developer mix. For example, in the embodiment illustrated, reservoir 302 includes a pair of augers 340*a*, 340*b*. Augers 340*a*, 340*b* are arranged to move the developer mix in opposite directions along the axial length of magnetic roll 306. For example, auger 340*a* is positioned to incorporate toner from inlet port 338 and to move the developer mix away from end 330 and toward end 331. Auger 340*b* is positioned to move the developer mix away from end 331, toward end 330 and in proximity to the bottom of magnetic roll 306. This arrangement of augers 340*a*, 340*b* is sometimes informally referred to as a racetrack arrangement because of the circular path the developer mix in reservoir 302 takes when augers 340*a*, 340*b* rotate.

Magnetic roll 306 includes a core 342 that includes one or more permanent magnets and that does not rotate relative to housing 322. A cylindrical sleeve 344 encircles core 342 and extends along the axial length of magnetic roll 306. In some embodiments, sleeve 344 has an outer diameter of 25 mm. In one embodiment, a shaft 346 passes through the center of core 342 and defines an axis of rotation 347 of magnetic roll 306. Shaft 346 is fixed, i.e., shaft 346 does not rotate with sleeve 344 relative to housing 322, and controls the position of core 342 relative to sleeve 344 and to the other components of developer unit 320. With reference back to FIG. 3, a rotatable end cap 345 is positioned at one axial end of magnetic roll 306, referred to as the drive side of magnetic roll 306. End cap 345 is coupled to sleeve 344 such that rotation of end cap 345 causes sleeve 344 to rotate around core 342. Sleeve 344 rotates in a clockwise direction as viewed in FIG. 5 to transport the developer mix from reservoir 302 to PC drum 310. A drive coupler 350 is operatively connected to end cap 345 either directly, such as on an end of a shaft 349 that extends axially outward from end cap 345 as shown in the example embodiment illustrated, or indirectly. Drive coupler 350 is positioned to receive rotational force from a corresponding drive coupler in image forming device 100 when developer unit 320 is installed in image forming device 100. Any suitable drive coupler 350 may be used as desired, such as a spur gear or a drive coupler that receives rotational force at its axial end. In one embodiment, augers 340*a*, 340*b* are operatively connected to drive coupler 350 by one or more intermediate gears (not shown). Alternatively, augers 340*a*, 340*b* may be driven independently of drive coupler 350 and sleeve 344 by a second drive coupler positioned to receive rotational force from a corresponding drive coupler in image forming device 100 when developer unit 320 is installed in image forming device 100.

Figure 6:
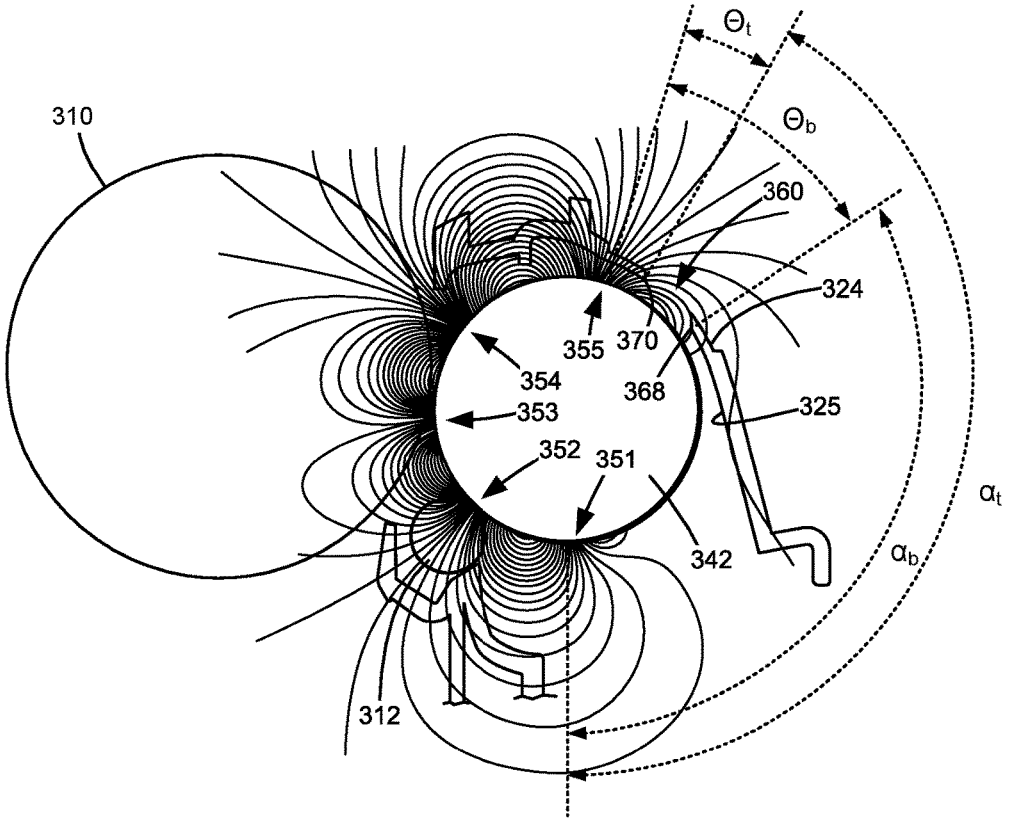
FIG. 6 is a schematic diagram of the developer unit of FIGS. 3-5 showing the magnetic field lines of a magnetic roll according to one example embodiment.

With reference to FIGS. 5 and 6, the permanent magnet(s) of core 342 produce a series of circumferentially spaced, alternating polarity (south v. north) magnetic poles 351-355 that facilitate the transport of developer mix to PC drum 310 as sleeve 344 rotates. A tangential component of the magnetic field of the permanent magnet(s) of core 342 is equal to zero at each pole 351-355. FIG. 6 shows the magnetic field lines generated by the magnetic poles of core 342 according to one example embodiment. Core 342 includes a pickup pole 351 positioned near the bottom of core 342 (near the 6 o'clock position of core 342 as viewed in FIG. 6). Pickup pole 351 magnetically attracts developer mix in reservoir 302 to the outer surface of sleeve 344. The magnetic attraction from core 342 causes the developer mix to form cone or bristle-like chains that extend from the outer surface of sleeve 344 along the magnetic field lines.

After the developer mix is picked up at pickup pole 351, as sleeve 344 rotates, the developer mix on sleeve 344 advances toward a trim bar 312. Trim bar 312 is positioned in close proximity to the outer surface of sleeve 344. Trim bar 312 trims the chains of developer mix as they pass to a predetermined average height defined by a trim bar gap 314 formed between trim bar 312 and the outer surface of sleeve 344 in order to control the mass of developer mix on the outer surface of sleeve 344. Trim bar gap 314 dictates how much developer mix is allowed to pass on the outer surface of sleeve 344 from reservoir 302 toward PC drum 310. Trim bar 312 may be magnetic or non-magnetic and may take a variety of different shapes including having a flat or rounded trimming surface. Trim bar 312 may be electrically biased to aid in trimming the chains of developer mix. Core 342 includes a trim pole 352 positioned at trim bar 312 to stand the chains of developer mix up on sleeve 344 in a generally radial orientation for trimming by trim bar 312. As shown in FIG. 6, between pickup pole 351 and trim pole 352, the chains of developer mix on sleeve 344 have a primarily tangential (as opposed to radial) orientation relative to the outer surface of sleeve 344 according to the magnetic field lines between pickup pole 351 and trim pole 352.

As sleeve 344 rotates further, the developer mix on sleeve 344 passes in close proximity to the outer surface of PC drum 310. As discussed above, electrostatic forces from the latent image formed on PC drum 310 by the laser beam from LSU 112 strip the toner from the carrier beads to form a toned image on the surface of PC drum 310. Core 342 includes a developer pole 353 positioned at the point where the outer surface of sleeve 344 passes in close proximity to the outer surface of PC drum 310 to once again stand the chains of developer mix up on sleeve 344 in a generally radial orientation to promote the transfer of toner from sleeve 344 to PC drum 310. The developer mix is less dense and less coarse when the chains of developer mix are stood up in a generally radial orientation than it is when the chains are more tangential. As a result, less wear occurs on the surface of PC drum 310 from contact between PC drum 310 and the chains of developer mix when the chains of developer mix on sleeve 344 are in a generally radial orientation.

As sleeve 344 continues to rotate, the remaining developer mix on sleeve 344, including the toner not transferred to PC drum 310 and the carrier beads, is carried by magnetic roll 306 past PC drum 310 and back toward reservoir 302. Core 342 includes a transport pole 354 positioned past the point where the outer surface of sleeve 344 passes in close proximity to the outer surface of PC drum 310. Transport pole 354 magnetically attracts the remaining developer mix to sleeve 344 to prevent the remaining developer mix from migrating to PC drum 310 or otherwise releasing from sleeve 344. As sleeve 344 rotates further, the remaining developer mix passes under lid 324 and is carried back to reservoir 302 by magnetic roll 306. Core 342 includes a release pole 355 positioned near the top of core 342 along the direction of rotation of sleeve 344. Release pole 355 magnetically attracts the remaining developer mix to sleeve 344 as the developer mix is carried the remaining distance to the point where it is released back into reservoir 302. As the remaining developer mix passes the 2 o'clock position of core 342 as viewed in FIG. 6, the developer mix is no longer magnetically retained against sleeve 344 by core 342 allowing the developer mix to fall via gravity and centrifugal force back into reservoir 302.

The return of developer mix to reservoir 302 by sleeve 344 creates an influx of air into reservoir 302. Turbulence created by the influx of air into reservoir 302 may tend to promote the separation of toner particles from the magnetic carrier beads. The influx of air into reservoir 302 also results in a corresponding outflow of air from reservoir 302. Uncontrolled outgoing air may tend to carry toner that has been separated from the magnetic carrier beads out of reservoir 302, where the toner may contaminate other components of image forming device 100. Accordingly, developer unit 320 is designed to reduce turbulence generated by the return of developer mix to reservoir 302 and to control the path of air exiting reservoir 302 in order to reduce the occurrence of toner dusting and leakage from reservoir 302.

With reference to FIGS. 4 and 5, housing 322 includes one or more air vents 360 through lid 324 that allow air to escape reservoir 302 and exit housing 322. FIG. 4 shows housing 322 with handle 336 removed to more clearly illustrate vents 360. Vents 360 are positioned on the rear side of lid 324, near the top of lid 324. As shown in FIG. 4, in the example embodiment illustrated, a series of air vents 360 are spaced along axial dimension 307, along the length of housing 322, between ends 330 and 331 of housing 322. In another embodiment, a single vent 360 stretches along axial dimension 307. Each vent 360 includes an opening 362 through lid 324 that permits air to exit housing 322. In the embodiment illustrated, the entire opening 362 of each vent 360 is positioned vertically higher than rotational axis 347 of magnetic roll 306 as shown in FIG. 5.

Each vent opening 362 is covered with an air filter 364 that prevents toner carried by the outgoing air from passing through the vent 360. An air filter 364 of one of the air vents 360 is shown separated from housing 322 in FIG. 4 to more clearly illustrate the corresponding opening 362. The material of air filter 364 is sufficiently porous to permit outgoing air to freely exit vents 360 while also filtering any toner present in the outgoing air. It is preferred that the material of air filter 364 repel the electrostatic charge of the toner so that toner does not tend to collect in air filter 364 in order to extend the useful life of air filter 364. In one embodiment, air filter 364 is composed of polytetrafluoroethylene (PTFE), such as, for example, Teflon™ by The Chemours Company, Wilmington, Del., United States of America, laminated onto a backing material, such as, for example, polypropylene, that provides structural stability.

Arrow 356 in FIG. 5 illustrates the air flow into reservoir 302 caused by the return of developer mix to reservoir 302 by sleeve 344. The incoming air flows in the operative rotational direction of sleeve 344 along the rear side of sleeve 344, opposite the portion of sleeve 344 that is exposed from reservoir 302 to deliver toner to PC drum 310. Arrow 358 in FIG. 5 illustrates the return flow of air out of reservoir 302. The outgoing air flows counter to the operative rotational direction of sleeve 344 along the inner surface 325 of lid 324 on the rear side of sleeve 344, toward air vents 360 through which the outgoing air exits reservoir 302.

Inner surface 325 of lid 324 along the rear side of sleeve 344 is positioned and contoured to promote the flow of outgoing air toward vents 360 and to provide sufficient space for the developer mix, which expands as it is released from sleeve 344, to reenter reservoir 302 and for the outgoing air to pass toward vents 360. Inner surface 325 of lid 324 extends upward along the rear side of sleeve 344 and curves forward toward front 332 of housing 322 in a spaced relationship from the outer surface of sleeve 344. In one embodiment, inner surface 325 of lid 324 is spaced radially (indicated by the distance $r_1$ in FIG. 5) with respect to rotational axis 347 from the outer surface of sleeve 344 by at least 2.5 mm and not more than 7.0 mm, including all increments and values therebetween (e.g., at least 2.7 mm and not more than 3.2 mm, etc.), from a point 366 on inner surface 325 that is vertically aligned with rotational axis 347 of magnetic roll 306 when developer unit 320 is in its operative orientation as shown in FIG. 5 (i.e., from the intersection of an imaginary horizontal line H drawn radially from rotational axis 347 with inner surface 325 of lid 324) to a bottom inner edge 368 of each vent 360. The distance from the outer surface of sleeve 344 to inner surface 325 of lid 324 between point 366 and bottom inner edge 368 of vent 360 may be constant or it may vary between point 366 and bottom inner edge 368. In those embodiments where housing 322 includes a series of air vents 360 spaced along axial dimension 307, the portions of inner surface 325 that extend axially between adjacent vents 360 may also be spaced radially with respect to rotational axis 347 from the outer surface of sleeve 344 by at least 2.5 mm and not more than 7.0 mm, including all increments and values therebetween, from bottom inner edge 368 of each vent 360 to a top inner edge 370 of each vent 360. Below point 366, the radial distance from the outer surface of sleeve 344 to inner surface 325 of lid 324 increases in order to provide sufficient room for the developer mix releasing from sleeve 344 to expand.

The entire opening 362 of each vent 360 is positioned vertically higher than the point where developer mix releases from the outer surface of sleeve 344 so that when the developer mix expands as it releases, the developer mix does not clog air filters 364. Vents 360 are positioned at the point where inner surface 325 of lid 324 transitions between facing primarily forward toward front 324 of housing 322 and facing primarily downward toward bottom 335 of housing 322 so that the outgoing airstream is naturally inclined to exit housing 322 through vents 360 as the outgoing air rises instead of bypassing vents 360 counter to the operative rotational direction of sleeve 344 and exiting through the gap 372 between lid 324 and the outer surface of sleeve 344 at front 332 of housing 322 where developer mix reenters housing 322 after passing PC drum 310.

In some embodiments, bottom inner edges 368 of vents 360 are positioned at least 35 degrees and not more than 55 degrees downstream from release pole 355 (indicated by the angle $\theta_b$ in FIG. 6) in the operative rotational direction of sleeve 344, including all increments and values therebetween (e.g., at least 37 degrees and not more than 52 degrees from release pole 355). In some embodiments, top inner edges 370 of vents 360 are positioned at least 12 degrees and not more than 30 degrees downstream from release pole 355 (indicated by the angle $\theta_t$ in FIG. 6) in the operative rotational direction of sleeve 344, including all increments and values therebetween at least 15 degrees and not more than 28 degrees from release pole 355). In some embodiments, bottom inner edges 368 of vents 360 are positioned at least 85 degrees and not more than 110 degrees upstream from pickup pole 351 (indicated by the angle $\alpha_b$ in FIG. 6) in the operative rotational direction of sleeve 344, including all increments and values therebetween (e.g., at least 91 degrees and not more than 107 degrees from pickup pole 351). In some embodiments, top inner edges 370 of vents 360 are positioned at least 110 degrees and not more than 130 degrees upstream from pickup pole 351 (indicated by the angle $\alpha_t$ in FIG. 6) in the operative rotational direction of sleeve 344, including all increments and values therebetween (e.g., at least 116 degrees and not more than 128 degrees from pickup pole 351). In some embodiments, bottom inner edges 368 of vents 360 are positioned at least 5 mm and not more than 10 mm vertically higher than rotational axis 347 (indicated by the distance $y_b$ in FIG. 5) when developer unit 320 is in its operative orientation, including all increments and values therebetween at least 6 mm and not more than 9 mm). In some embodiments, top inner edges 370 of vents 360 are positioned at least 10 mm and not more than 15 mm vertically higher than rotational axis 347 (indicated by the distance $y_t$ in FIG. 5) when developer unit 320 is in its operative orientation, including all increments and values therebetween (e.g., at least 12 mm and not more than 14 mm).

Openings 362 of vents 360 are positioned in close proximity to the outer surface of sleeve 344. In one embodiment, openings 362 of vents 360 are spaced radially (indicated by the distance $r_2$ in FIG. 5) with respect to rotational axis 347 from the outer surface of sleeve 344 by at least 2.5 mm and not more than 7.0 mm, including all increments and values therebetween (e.g., at least 2.7 mm and not more than 3.2 mm, etc.).

In some embodiments, the surfaces of a lower wall 374 that extends transverse through lid 324 from bottom inner edge 368 to a bottom outer edge 369 of vent 360 and an upper wall 376 that extends transverse through lid 324 from top inner edge 370 to a top outer edge 371 of vent 360 are oriented vertically as shown in FIG. 5 when developer unit 320 is in its operative orientation. The vertical orientation of walls 374, 376 aids in directing the outgoing air flow passing near inner surface 325 of lid 324 into vents 360.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A developer unit for a dual component development electrophotographic image forming device, comprising:

a housing having a reservoir for storing a developer mix that includes toner and magnetic carrier beads;

a magnetic roll mounted on the housing, the magnetic roll includes a core and a sleeve positioned around the core, the sleeve is rotatable in an operative rotational direction around the core about a rotational axis, the core includes at least one permanent magnet having a plurality of circumferentially spaced magnetic poles that magnetically attract the developer mix to an outer surface of the sleeve for carrying by the sleeve as the sleeve rotates in the operative rotational direction, the outer surface of the sleeve is positioned to carry the developer mix from the reservoir through a front portion of the magnetic roll that is exposed from the reservoir to permit transfer of toner from the outer surface of the sleeve to a photoconductive drum and back to the reservoir as the sleeve rotates in the operative rotational direction; and an air vent positioned along a rear portion of the magnetic roll opposite the front portion of the magnetic roll for exiting air in the reservoir from the housing, an entire opening of the air vent is positioned vertically higher than the rotational axis of the sleeve when the developer unit is in an operative orientation, wherein a lower wall that extends from a bottom inner edge of the opening of the vent to a bottom outer edge of the opening of the vent and an upper wall that extends from a top inner edge of the opening of the vent to a top outer edge of the opening of the vent are oriented vertically when the developer unit is in the operative orientation.

2. The developer unit of claim 1, wherein the air vent is positioned vertically higher than a point where the developer mix releases from the outer surface of the sleeve into the reservoir after passing the exposed front portion of the magnetic roll during rotation of the sleeve in the operative rotational direction.

3. The developer unit of claim 1, wherein the bottom inner edge of the opening of the air vent is positioned at least 5 mm and not more than 10 mm vertically higher than the rotational axis of the sleeve when the developer unit is in the operative orientation.

4. The developer unit of claim 3, wherein the top inner edge of the opening of the air vent is positioned at least 10 mm and not more than 15 mm vertically higher than the rotational axis of the sleeve when the developer unit is in the operative orientation.

5. The developer unit of claim 1, wherein the plurality of magnetic poles includes a release pole that is positioned to magnetically attract developer mix to the outer surface of the sleeve for carrying by the sleeve as the sleeve rotates in the operative rotational direction to a point where the developer mix releases from the outer surface of the sleeve into the reservoir, wherein the bottom inner edge of the opening of the vent is positioned at least 35 degrees and not more than 55 degrees downstream from the release pole in the operative rotational direction of the sleeve.

6. The developer unit of claim 5, wherein the top inner edge of the opening of the vent is positioned at least 12 degrees and not more than 30 degrees downstream from the release pole in the operative rotational direction of the sleeve.

7. The developer unit of claim 1, wherein the plurality of magnetic poles includes a pickup pole that is positioned to magnetically attract developer mix onto the outer surface of the sleeve from the reservoir for carrying by the sleeve as the sleeve rotates in the operative rotational direction, wherein the bottom inner edge of the opening of the vent is positioned at least 85 degrees and not more than 110 degrees upstream from the pickup pole in the operative rotational direction of the sleeve.

8. The developer unit of claim 7, wherein the top inner edge of the opening of the vent is positioned at least 110 degrees and not more than 130 degrees upstream from the pickup pole in the operative rotational direction of the sleeve.

9. The developer unit of claim 1, wherein an inner surface of the housing extending along the rear portion of the magnetic roll is spaced radially with respect to the rotational axis of the sleeve from the outer surface of the sleeve by at least 2.5 mm and not more than 7.0 mm, from a point on the inner surface that is vertically aligned with the rotational axis of the sleeve when the developer unit is in the operative orientation to the bottom inner edge of the opening of the vent.

10. The developer unit of claim 1, wherein an inner surface of the housing extends along the rear portion of the magnetic roll and curves above the magnetic roll toward the front portion of the magnetic roll, the inner surface of the housing is spaced from the outer surface of the sleeve, the air vent is positioned at a point where the inner surface of the housing transitions between facing primarily forward toward the rear portion of the magnetic roll and primarily downward when the developer unit is in the operative orientation.

11. A developer unit for a dual component development electrophotographic image forming device, comprising:

a housing having a reservoir for storing a developer mix that includes toner and magnetic carrier beads;

a magnetic roll mounted on the housing, the magnetic roll includes a core and a sleeve positioned around the core, the sleeve is rotatable in an operative rotational direction around the core about a rotational axis, the core includes at least one permanent magnet having a plurality of circumferentially spaced magnetic poles that magnetically attract the developer mix to an outer surface of the sleeve for carrying by the sleeve as the sleeve rotates in the operative rotational direction, the outer surface of the sleeve is positioned to carry the developer mix from the reservoir through a portion of the magnetic roll that is exposed from the reservoir to permit transfer of toner from the outer surface of the sleeve to a photoconductive drum and back to the reservoir as the sleeve rotates in the operative rotational direction; and an air vent positioned in close proximity to the outer surface of the sleeve for exiting air in the reservoir from the housing, the air vent is positioned downstream from a point where developer mix on the outer surface of the sleeve reenters the housing after passing the exposed portion of the magnetic roll during rotation of the sleeve in the operative rotational direction and upstream from a point where the developer mix releases from the outer surface of the sleeve after reentering the housing during rotation of the sleeve in the operative rotational direction, wherein a lower wall that extends from a bottom inner edge of an opening of the vent to a bottom outer edge of the opening of the vent and an upper wall that extends from a top inner edge of the opening of the vent to a top outer edge of the opening of the vent are oriented vertically when the developer unit is in an operative orientation.

12. The developer unit of claim 11, wherein an entire opening of the air vent is positioned vertically higher than the rotational axis of the sleeve when the developer unit is in an operative orientation.

13. The developer unit of claim 11, wherein the bottom inner edge of an opening of the air vent is positioned at least 5 mm and not more than 10 mm vertically higher than the rotational axis of the sleeve when the developer unit is in an operative orientation.

14. The developer unit of claim 13, wherein the top inner edge of the opening of the air vent is positioned at least 10 mm and not more than 15 mm vertically higher than the rotational axis of the sleeve when the developer unit is in the operative orientation.

15. The developer unit of claim 11, wherein the plurality of magnetic poles includes a release pole that is positioned to magnetically attract developer mix to the outer surface of the sleeve for carrying by the sleeve as the sleeve rotates in the operative rotational direction to the point where the developer mix releases from the outer surface of the sleeve into the reservoir, wherein the bottom inner edge of an opening of the vent is positioned at least 35 degrees and not more than 55 degrees downstream from the release pole in the operative rotational direction of the sleeve.

16. The developer unit of claim 15, wherein the top inner edge of the opening of the vent is positioned at least 12 degrees and not more than 30 degrees downstream from the release pole in the operative rotational direction of the sleeve.

17. The developer unit of claim 11, wherein the plurality of magnetic poles includes a pickup pole that is positioned to magnetically attract developer mix onto the outer surface of the sleeve from the reservoir for carrying by the sleeve as the sleeve rotates in the operative rotational direction, wherein the bottom inner edge of an opening of the vent is positioned at least 85 degrees and not more than 110 degrees upstream from the pickup pole in the operative rotational direction of the sleeve.

18. The developer unit of claim 17, wherein the top inner edge of the opening of the vent is positioned at least 110 degrees and not more than 130 degrees upstream from the pickup pole in the operative rotational direction of the sleeve.

19. The developer unit of claim 11, wherein a front portion of the magnetic roll is exposed from the reservoir and an inner surface of the housing extending along a rear portion of the magnetic roll opposite the front portion of the magnetic roll is spaced radially with respect to the rotational axis of the sleeve from the outer surface of the sleeve by at least 2.5 mm and not more than 7.0 mm, from a point on the inner surface that is vertically aligned with the rotational axis of the sleeve when the developer unit is in an operative orientation to the bottom inner edge of an opening of the vent.

20. The developer unit of claim 11, wherein a front portion of the magnetic roll is exposed from the reservoir and an inner surface of the housing extends along a rear portion of the magnetic roll opposite the front portion of the magnetic roll and curves above the magnetic roll toward the front portion of the magnetic roll, the inner surface of the housing is spaced from the outer surface of the sleeve, the air vent is positioned at a point where the inner surface of the housing transitions between facing primarily forward toward the rear portion of the magnetic roll and primarily downward when the developer unit is in an operative orientation.

21. A developer unit for a dual component development electrophotographic image forming device, comprising:

a housing having a reservoir for storing a developer mix that includes toner and magnetic carrier beads;

a magnetic roll mounted on the housing, the magnetic roll includes a core and a sleeve positioned around the core, the sleeve is rotatable in an operative rotational direction around the core about a rotational axis, the core includes at least one permanent magnet having a plurality of circumferentially spaced magnetic poles that magnetically attract the developer mix to an outer surface of the sleeve for carrying by the sleeve as the sleeve rotates in the operative rotational direction, the outer surface of the sleeve is positioned to carry the developer mix from the reservoir through a portion of the magnetic roll that is exposed from the reservoir to permit transfer of toner from the outer surface of the sleeve to a photoconductive drum and back to the reservoir as the sleeve rotates in the operative rotational direction; and an air vent positioned in close proximity to the outer surface of the sleeve for exiting air in the reservoir from the housing, the air vent is positioned downstream from a point where developer mix on the outer surface of the sleeve reenters the housing after passing the exposed portion of the magnetic roll during rotation of the sleeve in the operative rotational direction and upstream from a point where the developer mix releases from the outer surface of the sleeve after reentering the housing during rotation of the sleeve in the operative rotational direction, wherein the plurality of magnetic poles includes a release pole that is positioned to magnetically attract developer mix to the outer surface of the sleeve for carrying by the sleeve as the sleeve rotates in the operative rotational direction to the point where the developer mix releases from the outer surface of the sleeve into the reservoir, wherein a bottom inner edge of an opening of the vent is positioned at least 35 degrees and not more than 55 degrees downstream from the release pole in the operative rotational direction of the sleeve.

22. The developer unit of claim 21, wherein a top inner edge of the opening of the vent is positioned at least 12 degrees and not more than 30 degrees downstream from the release pole in the operative rotational direction of the sleeve.

* * * * *